US011286091B2

(12) United States Patent
Borse et al.

(10) Patent No.: US 11,286,091 B2
(45) Date of Patent: Mar. 29, 2022

(54) TAMPER EVIDENT CONTAINER

(71) Applicants: Robert J. Borse, Plainfield, IL (US); Michael R. Borse, Western Springs, IL (US); Joseph J. Borse, Chicago, IL (US)

(72) Inventors: Robert J. Borse, Plainfield, IL (US); Michael R. Borse, Western Springs, IL (US); Joseph J. Borse, Chicago, IL (US)

( * ) Notice: Subject to any disclaimer, the term of this patent is extended or adjusted under 35 U.S.C. 154(b) by 78 days.

(21) Appl. No.: 16/749,034

(22) Filed: Jan. 22, 2020

(65) Prior Publication Data

US 2021/0221582 A1 Jul. 22, 2021

(51) Int. Cl.
*B65D 55/02* (2006.01)
*B65D 43/16* (2006.01)

(52) U.S. Cl.
CPC ..... *B65D 55/024* (2013.01); *B65D 43/162* (2013.01); *B65D 2401/15* (2020.05); *B65D 2401/20* (2020.05); *B65D 2401/25* (2020.05); *B65D 2543/00194* (2013.01)

(58) Field of Classification Search
CPC ..... B65D 55/024; B65D 43/162; B65D 2401/20; B65D 2401/25; B65D 2401/15; B65D 2543/00194
See application file for complete search history.

(56) References Cited

U.S. PATENT DOCUMENTS 3,933,296 A 1/1976 Ruskin et al.
4,576,330 A 3/1986 Schepp
4,653,643 A 3/1987 Black
5,046,659 A 9/1991 Warburton
5,169,014 A 12/1992 Hexamer
5,938,068 A 8/1999 Atkins et al.
6,305,546 B1 10/2001 Saunders et al.
7,073,680 B2 7/2006 Boback et al.
7,118,003 B2 10/2006 Sellari et al.
7,712,626 B2 5/2010 Vovan
7,992,743 B2 8/2011 Vovan
8,251,249 B1 8/2012 Vovan
8,360,262 B2 1/2013 Vovan
8,371,468 B2 2/2013 Sellari et al.
(Continued)

FOREIGN PATENT DOCUMENTS

DE 202010000231 U1 12/2010

*Primary Examiner* — Rafael A Ortiz
*Assistant Examiner* — Sanjidul Islam
(74) *Attorney, Agent, or Firm* — McDonnell Boehnen Hulbert & Berghoff LLP

(57) ABSTRACT

A container including a base having a first flange extending from a side of the base; a lid having a second flange extending from a side of the lid, wherein the first flange and second flange are coupled together at a living hinge, a first perforation cut positioned on the first flange or the second flange, a plurality of bubbles or raised portions positioned on the flange which does not have the first perforation cut, wherein the bubbles or raised portions are positioned over the first perforation cut when the lid is closed on the base, wherein when the bubbles or raised portions are pressed down onto the first perforation cut, the first perforation cut is broken to separate the lid from the base, and wherein the bubbles or raised portions are deformed when they are depressed to provide a visual indication that the container has been opened.

14 Claims, 5 Drawing Sheets

(56) References Cited

U.S. PATENT DOCUMENTS

| | | | | |
|---|---|---|---|---|
| 8,684,217 | B2 | 4/2014 | Bruehl et al. | |
| 8,807,385 | B1 | 8/2014 | Fosse | |
| 8,939,307 | B2 | 1/2015 | Gingras et al. | |
| 9,016,503 | B2 | 4/2015 | Barbier et al. | |
| 2010/0102074 | A1 | 4/2010 | Parikh et al. | |
| 2011/0083975 | A1 | 4/2011 | McGrane | |
| 2014/0190970 | A1 | 7/2014 | Huang | |
| 2014/0224803 | A1 | 8/2014 | Pickering | |
| 2017/0305616 | A1* | 10/2017 | Barbier | B65D 43/162 |
| 2020/0331674 | A1* | 10/2020 | Murphy | B65D 43/162 |

* cited by examiner

TAMPER EVIDENT CONTAINER

BACKGROUND

The present application generally relates to the field of containers. Plastic containers are used to hold various food items, such as nuts, salads, bakery items, etc., as well as other products. Over the years, there has been a trend to provide a visual indication to consumers as to whether a container has been previously opened, or perhaps even tampered with. If a consumer sees that a food container has been opened, he or she will choose a different food container without an indication that the food container has already been opened, or tampered with.

Typically, food containers are made of a clear plastic material so that a consumer can view the contents of the container. Many food containers have a clamshell configuration where a lid is attached to a base on an upper side of the base prior to the opening of the food container. Once the lid is opened it is typically remains attached to the base. When the lid is put back onto the base, it may not be readily apparent to a consumer that the lid has been opened or removed from the base.

In view of the foregoing, it would be desirable to provide a container that provides a visual indication that the lid has been removed from the base.

SUMMARY

The present embodiments are directed to a tamper evident container having a perforated or weakened connection (e.g., from a perforation cut or score cut) between a base and a lid prior to opening. The perforation cut or weakened section (e.g. from a perforation cut or score cut) between the base and lid is provided such that when the perforated or weakened connection between the base and the lid is broken, the lid is no longer connected to the base and the lid is separate from the base such that the separated lid can be removed from the base.

Half bubbles or raised portions are advantageously positioned over the perforated or weakened connection. To break the perforated or weakened connection, the bubbles or raised portions are depressed resulting in a deformation of the bubbles or raised portions to break the perforated or weakened connection between the lid and the base. If the lid is placed back onto the base, the deformed bubbles or raised portions provide a visual indication that the container has already been opened, or even tampered with. A plurality of raised assist beads can also be positioned beneath the half bubbles or raised portions to assist in breaking the connection along the perforated or weakened connection between the lid and the base.

In one aspect, a container is provided including a base having a first flange extending from a side of the base, a lid having a second flange extending from a side of the lid, wherein the first flange and second flange are coupled together at a living hinge positioned at ends of the first flange and the second flange, a first perforation cut or score cut positioned on the first flange or the second flange, a plurality of bubbles or raised portions positioned on the flange which does not have the first perforation cut or score cut, wherein the plurality of bubbles or raised portions are positioned over the first perforation cut or score cut when the lid is closed on the base, and wherein when the bubbles or raised portions are pressed down onto the first perforation cut or score cut, the first perforation cut or score cut is broken to separate the lid from the base, and wherein the bubbles or raised portions are deformed when they are depressed to provide a visual indication that the container has been opened.

In another aspect, a method of providing a visual indication that a container has been opened is provided including the steps of (i) providing a container including a base having a first flange extending from a side of the base; a lid having a second flange extending from a side of the lid, wherein the first flange and second flange are coupled together at a living hinge positioned at ends of the first flange and the second flange, a first perforation cut or score cut positioned on the first flange or the second flange, a plurality of bubbles or raised portions positioned on the flange which does not have the first perforation cut or score cut, wherein the bubbles or raised portions are positioned over the first perforation cut or score cut when the lid is closed on the base, and wherein when the bubbles or raised portion are pressed down onto the perforation cut or score cut, the first perforation cut or score cut is broken to separate the lid from the base; (ii) depressing the bubbles or raised portion until the perforation cut or score cut is broken to separate the lid from the base; and (iii) deforming the bubbles or raised portions during depressing the bubbles or raised portions step to provide a visual indication that the container has been opened.

BRIEF DESCRIPTION OF THE DRAWINGS

Exemplary embodiments of the invention are described herein with reference to the drawings, wherein like parts are designated by like reference numerals, and wherein.

DETAILED DESCRIPTION

Example embodiments have been described above. Those skilled in the art will understand that changes and modifications may be made to the described embodiments without departing from the true scope of the present invention, which is defined by the claims.

Figure 1A:
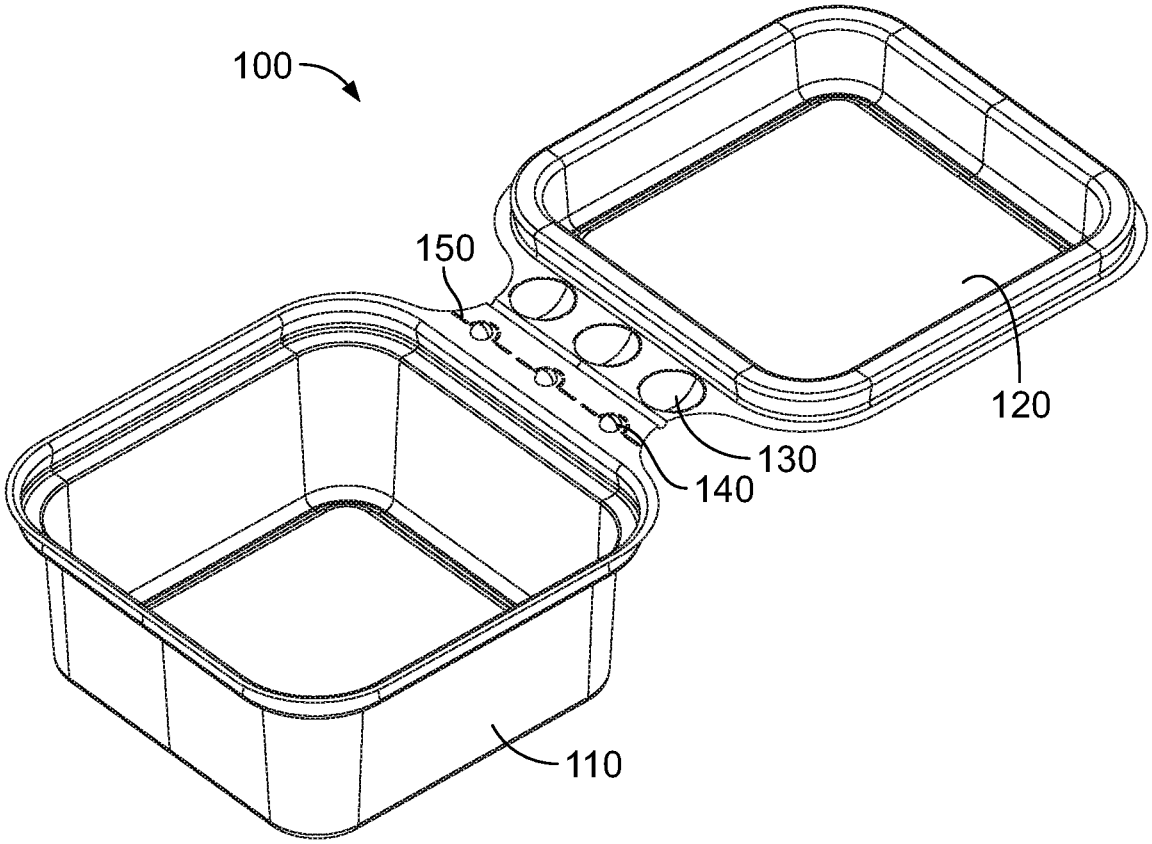
FIG. 1A is a perspective view of container 100 with the lid in an open position, according to an example embodiment.
Figure 1B:
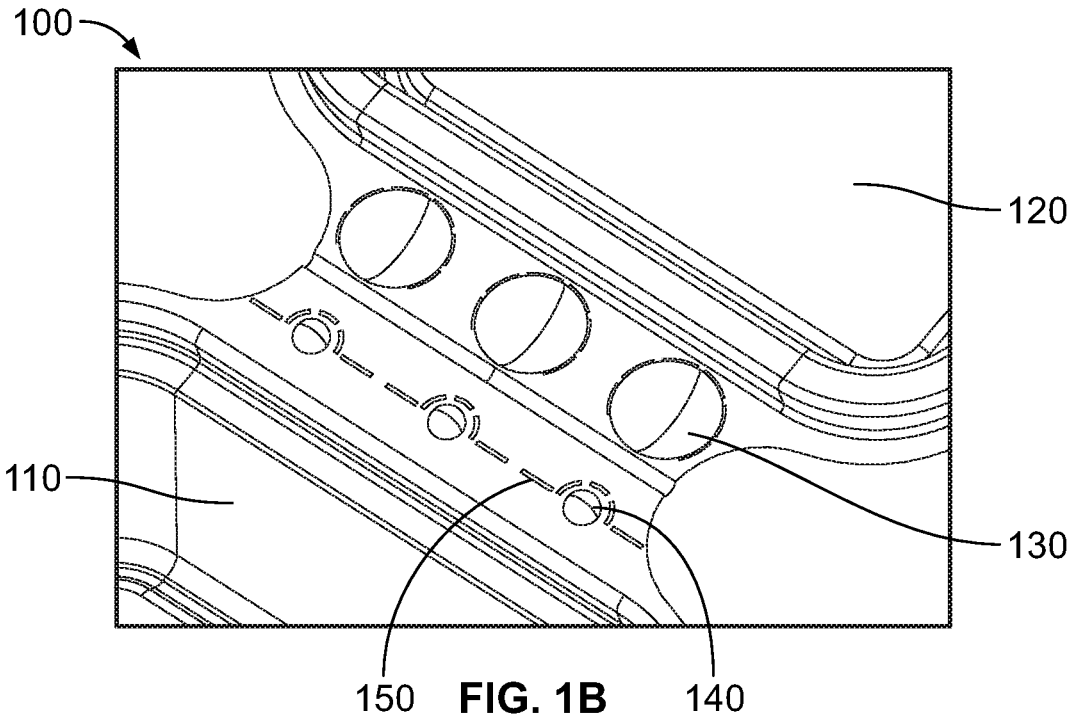
FIG. 1B is a close up view of the container 100 shown in FIG. 1A.

FIG. 1A is a perspective view of container 100 with lid 120 in an open position attached to base 110, according to an example embodiment. Lid 120 is attached to base 110 with a living hinge between flanges extending from the lid 120 and the base 110. FIG. 1B is a close up view of the container 100 shown in FIG. 1A. The extending flange on the base 110 includes a first perforation cut or score cut 150.

The extending flange on the lid 120 includes a plurality of bubbles or raised portions 130 that extend over the perforation cut or score cut 150 when the lid 120 is in a closed position over base 110. A plurality of raised assist beads 140 are positioned adjacent the first perforation cut or score cut 150. It will be appreciated that the perforation cut or score cut 150 may alternately be positioned on the extending flange of the lid 120, and that the bubbles or raised portions 130 may be positioned on the extending flange of the based 110.

Figure 2A:
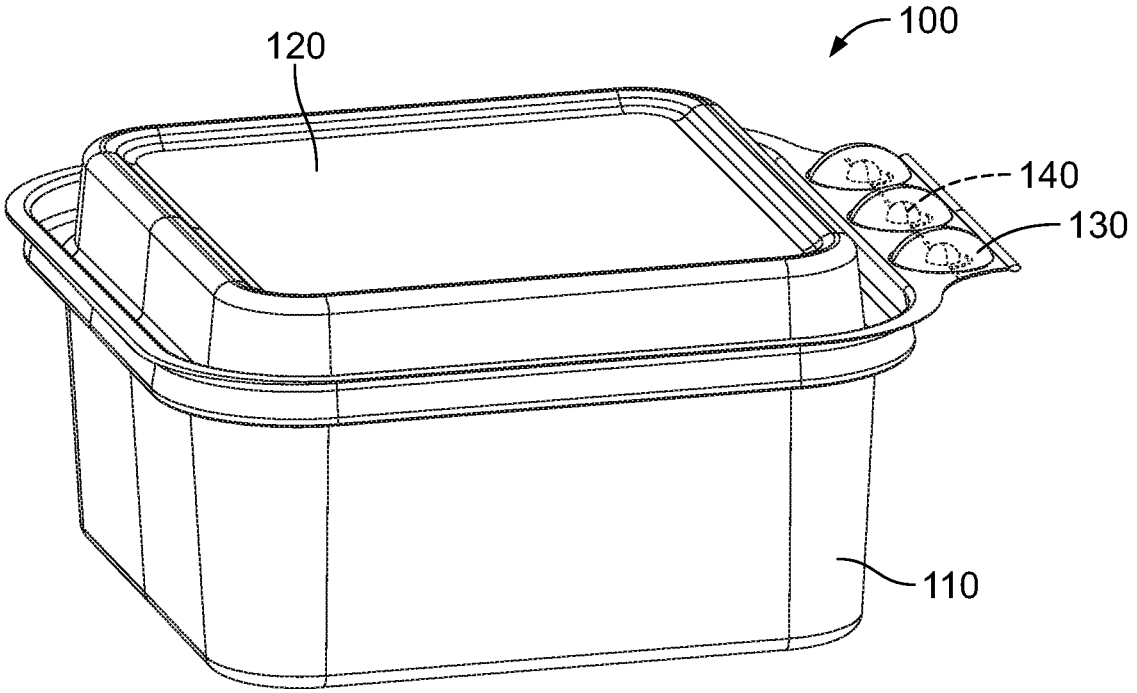
FIG. 2A is a another perspective view of container 100 shown in FIGS. 1A and 1B with the lid in a closed position.
Figure 2B:
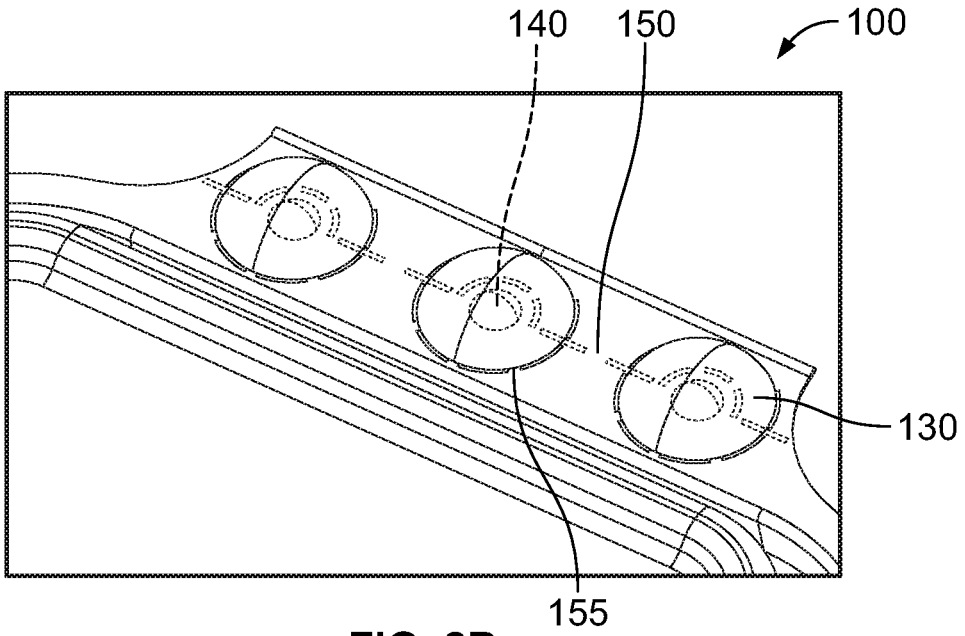
FIG. 2B is a close up view of the bubbles or raised portions 130 positioned over a perforated cut or score cut 150 on flanges of beverage container 100 shown in FIG. 2A.

FIG. 2A is a another perspective view of container 100 shown in FIGS. 1A and 1B with the lid 120 in a closed position with respect to the base 110. FIG. 2B is a close up view of the bubbles or raised portions 130 positioned over a first perforated cut or score cut on flanges of beverage container 100 shown in FIG. 2A. A second perforation cut or score cut 155 is positioned around bubbles or raised portions 130. When lid 120 is closed with respect to base 110, there is a tight fit between the lid 120 and base 110 on a side opposite from where the extending flanges are positioned, so that the lid may not be removed from the base from that side. There are no tabs on this side to allow for opening of the lid off of the base. To remove the lid 120 from the base 110, the bubbles or raised portions 130 are depressed to break the first perforation cut or score cut 150. Raised assist beads 140 assist in breaking the first perforation cut or score cut 150. Once the first perforation cut or score cut 150 is broken, the extending flange on the lid 120 serves as a tab to effect removal of the lid 120 from base 110. The bubbles or raised portions 140 are advantageously deformed upon depression such that the when the lid 120 is placed back onto the base 110, the deformed bubbles or raised portions 130 provide a visual indication that the lid has been removed from the base and the container 100 has been opened, or tampered with.

Figure 3A:
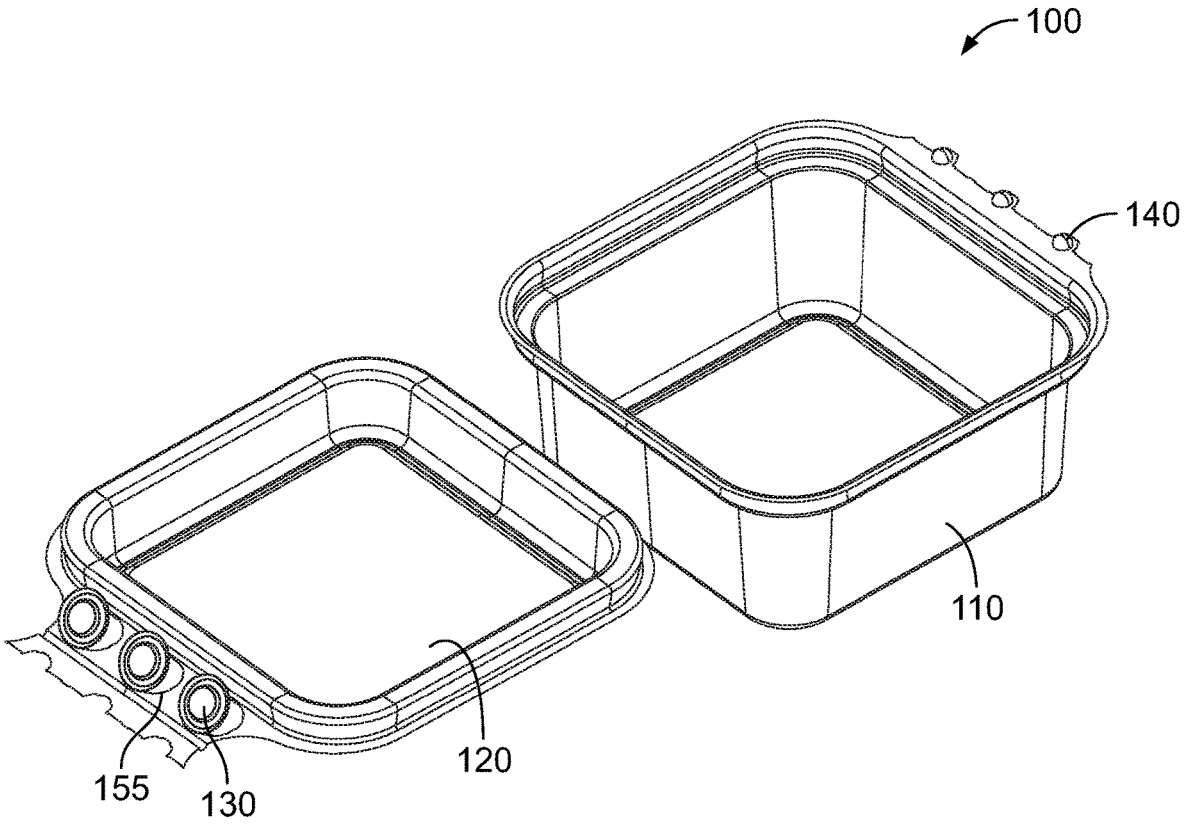
FIG. 3A is a perspective view of container 100 after the perforation cut or score cut has been broken with the lid unattached to the base.
Figure 3B:
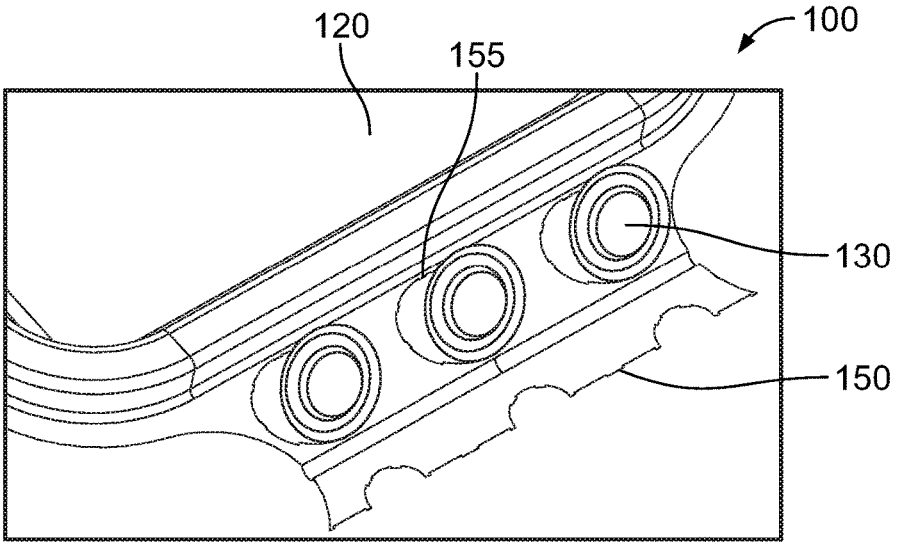
FIG. 3B is a close up view of the lid shown in FIG. 3A.

FIG. 3A is a perspective view of container 100 after the first perforation cut or score cut 150 has been broken with the lid 120 unattached to the base 110. FIG. 3B is a close up view of the lid 120 shown in FIG. 3A. In FIGS. 3A and 3B, raised portions 130 are positioned on a flange extending from the lid 120. Raised portions 130 could alternatively be positioned on a flange extending from the base 110. A second perforation cut or score cut 155 is advantageously positioned partially around raised portions 130. Upon depression of the bubbles or raised portions 130, the second perforation cut or score cut 155 positioned partially around the bubbles or raised portions is at least partially broken, to provide a visual indication that the container has been opened, or tampered with. The second perforation cut or score cut 155 positioned partially around the bubbles or raised portions 130 is weaker than the first perforation cut or score cut on the extending flange of the base 110, such that the second perforation cut or score cut 155 around raised portions 130 is at least partially broken before the first perforation cut or score cut 150 on the extending flange of the base 110 is broken. The at least partial breakage of the second perforation cut or score cut 155 positioned partially around the bubbles or raised portions 130 provides a visual indication that the container has been opened, or tampered with. As shown in FIGS. 3A and 3B, the bubbles or raised portions 130 advantageously remain attached to the flange which provides an environmental advantage in that the bubbles or raised portions 130 remain attached and do not completely separate from the flange.

Figure 4A:
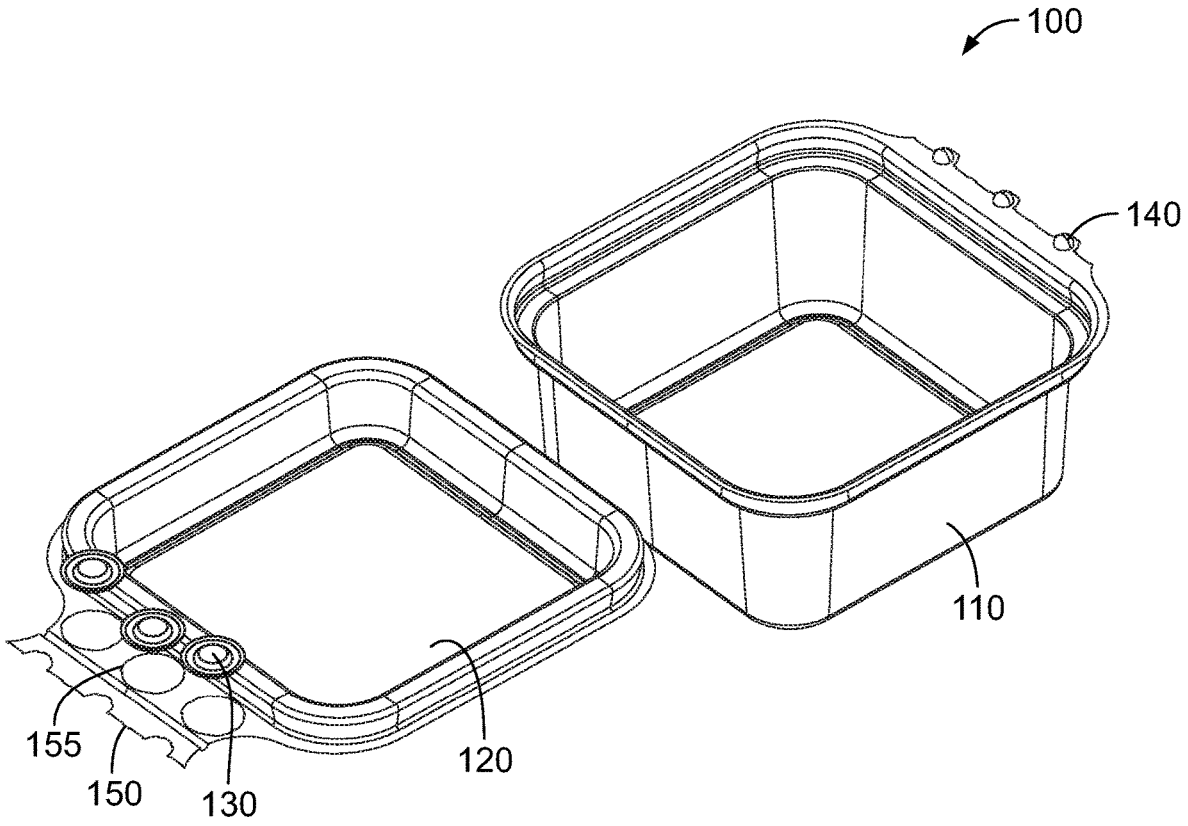
FIG. 4A is a perspective view of container 100 with lid 120 separated from base 110.
Figure 4B:
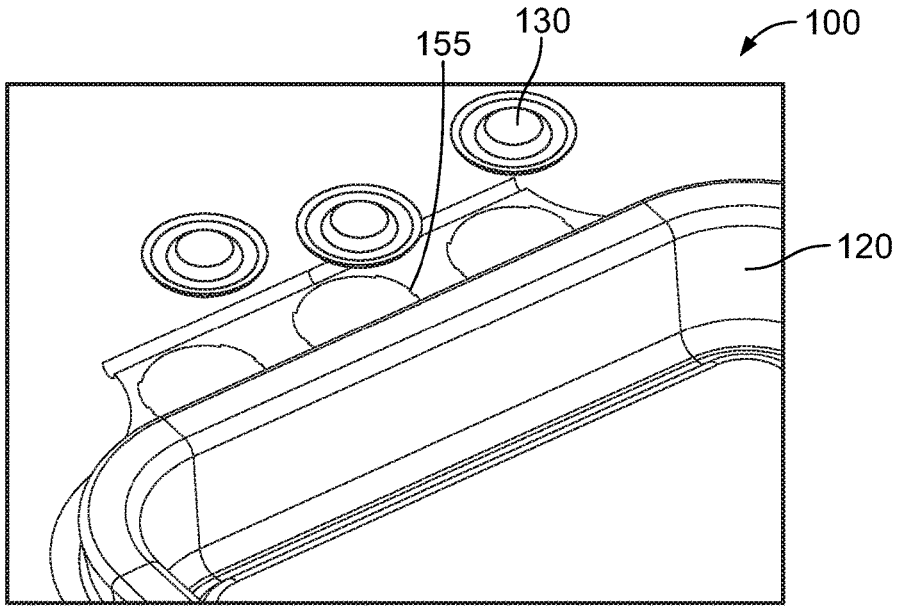
FIG. 4B is a close up view of lid 120 with raised portions 130 removed.

FIG. 4A is a perspective view of container 100 with lid 120 separated from base 110. In the embodiment shown in FIGS. 4A and 4B, the second perforation cut or score cut 155 extends completely around bubbles or raised portions 130, such that when the bubbles or raised portions 130 are depressed, the raised portions are completely removed from the extending flange of lid 120. The complete removal of bubbles or raised portions 130 of the extending flange of lid 120 serves to provide a visual indication that container 100 has been opened, or tampered with. The second perforation cut or score cut 155 around raised portions 130 is weaker than the first perforation cut or score cut 150 on the extending flange on the base 110, such that the second perforation cut or score cut 155 around the bubbles or raised portions 130 is broken before the first perforation cut or score 150 on the extending flange on the base 110 is broken.

Figure 5A:
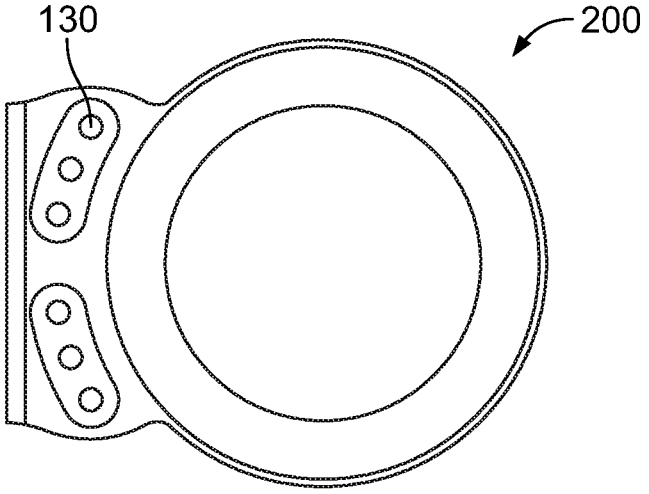
FIG. 5A is a top view of container 200.
Figure 5B:
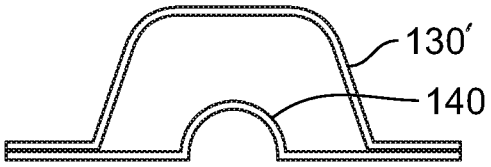
FIG. 5B is a side view of raised portion 130'.
Figure 5C:
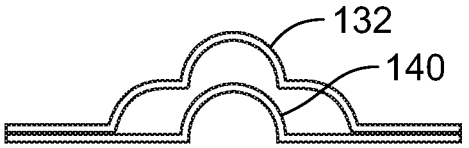
FIG. 5C is a side view of raised portion 132.
Figure 5D:
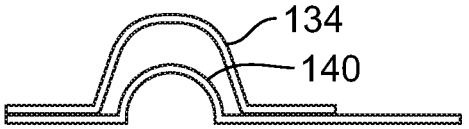
FIG. 5D is a side view of raised portion 134.

FIG. 5A is a top view of container 200, with an alternate arrangement of bubbles or raised portions 130. In FIG. 5A, container 200 is a round container. FIG. 5B is a side view of raised portion 130'. FIG. 5C is a side view of raised portion 132, and FIG. 5D is a side view of raised portion 134. In FIG. 5B, raised portion 130' has a flat top surface and extends over raised assist bead 140. In FIG. 5C, raised portion 132 has a half spherical bubble extending above raised assist bead 140. In FIG. 5D, raised portion 134 is configured as an oval-shaped member extending over raised assist bead 140.

It will be appreciated that the bubbles or raised portions 130 and raised assist beads 140 may vary in size, shape, and number. The examples provided herein, are exemplary, and do limit the bubbles or raised portions 130 and raised assist beads 140 are not limited to any particular size, shape, or number shown in the Figures.

We claim:

1. A container, comprising:

a base having a first flange extending from a side of the base;

a lid having a second flange extending from a side of the lid;

wherein the first flange and second flange are coupled together at a living hinge positioned at ends of the first flange and the second flange;

a first perforation cut or score cut positioned on the first flange or the second flange;

a plurality of bubbles or raised portions positioned on the first or second flange which does not have the perforation cut or score cut;

wherein the bubbles or raised portions are positioned over the first perforation cut or score cut when the lid is closed on the base;

wherein the bubbles or raised portions are deformable when pressed down onto the first perforation cut or score cut, such that the first perforation cut or score cut is broken to separate the lid from the base; and wherein the bubbles or raised portions are deformable when depressed to provide a visual indication that the container has been opened; and wherein there are at least three bubbles or raised portion in the plurality of bubbles or raised portions positioned over the first perforation cut or score cut.

2. The container of claim 1, wherein the bubbles or raised portions are configured as a partial sphere.

3. The container of claim 1, wherein after the first perforation cut or score cut is broken, the second flange on the lid serves as a tab to aid in the removal of lid from the base.

4. A container, comprising:

a base having a first flange extending from a side of the base;

a lid having a second flange extending from a side of the lid;

wherein the first flange and second flange are coupled together at a living hinge positioned at ends of the first flange and the second flange;

a first perforation cut or score cut positioned on the first flange or the second flange;

a plurality of bubbles or raised portions positioned on the first or second flange which does not have the perforation cut or score cut;

wherein the bubbles or raised portions are positioned over the first perforation cut or score cut when the lid is closed on the base;

wherein when the bubbles or raised portions are pressed down onto the first perforation cut or score cut, the first perforation cut or score cut is broken to separate the lid from the base;

wherein the bubbles or raised portions are deformed when they are depressed to provide a visual indication that the container has been opened;

wherein a plurality of raised assist beads are positioned next to the first perforation cut or score cut to assist in breaking the first perforation cut or score cut when the bubbles or raised portions are pressed down onto the first perforation cut or score cut; and wherein the first perforation cut or score cut extends around the raised assist beads.

5. A container, comprising:

a base having a first flange extending from a side of the base;

a lid having a second flange extending from a side of the lid;

wherein the first flange and second flange are coupled together at a living hinge positioned at ends of the first flange and the second flange;

a first perforation cut or score cut positioned on the first flange or the second flange;

a plurality of bubbles or raised portions positioned on the first or second flange which does not have the perforation cut or score cut;

wherein the bubbles or raised portions are positioned over the first perforation cut or score cut when the lid is closed on the base;

wherein when the bubbles or raised portions are pressed down onto the first perforation cut or score cut, the first perforation cut or score cut is broken to separate the lid from the base;

wherein the bubbles or raised portions are deformed when they are depressed to provide a visual indication that the container has been opened; and wherein a second perforation cut or score cut is positioned at least partially around the bubbles or raised portions so that when the bubbles or raised portion are depressed the bubbles or raised portions are at least partially broken away from the flange on which the bubbles or raised portions are positioned.

6. The container of claim 5, wherein the second perforation cut or score cut around the bubbles or raised portions is weaker than the first perforation cut or score cut on the flange over which the bubbles or raised portions are positioned when the lid is positioned on the base such that the second perforation cut or score cut around the bubbles or raised portions is at least partially broken before the first perforation cut or score cut on the opposite flange is broken.

7. A container, comprising:

a base having a first flange extending from a side of the base;

a lid having a second flange extending from a side of the lid;

wherein the first flange and second flange are coupled together at a living hinge positioned at ends of the first flange and the second flange;

a first perforation cut or score cut positioned on the first flange or the second flange;

a plurality of bubbles or raised portions positioned on the first or second flange which does not have the perforation cut or score cut;

wherein the bubbles or raised portions are positioned over the first perforation cut or score cut when the lid is closed on the base;

wherein when the bubbles or raised portions are pressed down onto the first perforation cut or score cut, the first perforation cut or score cut is broken to separate the lid from the base;

wherein the bubbles or raised portions are deformed when they are depressed to provide a visual indication that the container has been opened; and wherein a second perforation cut or score cut is positioned entirely around the bubbles or raised portions such that when the bubbles or raised portions are depressed the bubbles or raised portions are entirely broken away from the flange on which the bubbles or raised portions are positioned.

8. The container of claim 7, wherein the second perforation cut or score cut around the bubbles or raised portions is weaker than the first perforation cut or score cut on the flange over which the bubbles or raised portions are positioned when the lid is positioned on the base such that the second perforation cut or score cut around the bubbles or raised portions are broken before the first perforation cut or score cut on the opposite flange is broken.

9. The container of claim 7, wherein a plurality of raised assist beads are positioned next to the first perforation cut or score cut to assist in breaking the first perforation cut or score cut when the bubbles or raised portions are pressed down onto the first perforation cut or score cut.

10. The container of claim 4, wherein there are three bubbles or raised portions in the plurality of bubbles or raised portions positioned over the first perforation cut or score cut and three raised assist beads in the plurality of raised assist beads when the lid is positioned on the base.

11. A container, comprising:

a base having a first flange extending from a side of the base;

a lid having a second flange extending from a side of the lid;

wherein the first flange and second flange are coupled together at a living hinge positioned at ends of the first flange and the second flange;

a first perforation cut or score cut positioned on the first flange or the second flange;

a plurality of bubbles or raised portions positioned on the first or second flange which does not have the perforation cut or score cut;

wherein the bubbles or raised portions are positioned over the first perforation cut or score cut when the lid is closed on the base;

wherein when the bubbles or raised portions are pressed down onto the first perforation cut or score cut, the first perforation cut or score cut is broken to separate the lid from the base;

wherein the bubbles or raised portions are deformed when they are depressed to provide a visual indication that the container has been opened;

wherein there is a tight fit between the lid and the base on a side of the container opposite of the side where the first and second flanges are positioned such that the container cannot be opened before the first perforation cut or score cut is broken; and wherein there is a looser fit between the lid and the base on the side where the first and second flanges are positioned than a fit between the lid and the base on the side of the container opposite of the side where the first and second flanges are positioned.

12. A method of providing a visual indication that a container has been opened comprising the steps of:

providing a container including a base having a first flange extending from a side of the base; a lid having a second flange extending from a side of the lid, wherein the first flange and second flange are coupled together at a living hinge positioned at ends of the first flange and the second flange, a first perforation cut or score cut positioned on the first flange or the second flange, a plurality of bubbles or raised portions positioned on the first or second flange which does not have the first perforation cut or score cut, wherein the bubbles or raised portions are positioned over the first perforation cut or score cut when the lid is closed on the base, and wherein when the bubbles or raised portions are pressed down onto the first perforation cut or score cut, the first perforation cut or score cut is broken to separate the lid from the base;

depressing the bubbles or raised portions until the first perforation cut or score cut is broken to separate the lid from the base;

deforming the bubbles or raised portions during depressing the bubbles or raised portions step to provide a visual indication that the container has been opened; and wherein a second perforation cut or score cut is positioned at least partially around the bubbles or raised portions so that when the bubbles or raised portions are depressed the bubbles or raised portion are at least partially broken away from the flange on which the bubbles or raised portions are positioned.

13. The method of claim 12, wherein a plurality of raised assist beads are positioned next to the first perforation cut or score cut to assist in breaking the first perforation cut or score cut when the bubbles or raised portions are pressed down onto the first perforation cut or score cut.

14. The method of claim 12, wherein the second perforation cut or score cut around the bubbles or raised portions is weaker than the first perforation cut or score cut on the flange over which the bubbles or raised portions are positioned when the lid is positioned on the base such that the second perforation cut or score cut around the bubbles or raised portions is broken before the first perforation cut or score cut on the opposite flange is broken.

* * * * *